US008357446B2

(12) United States Patent
Wank et al.

(10) Patent No.: US 8,357,446 B2
(45) Date of Patent: Jan. 22, 2013

(54) HOLLOW POLYMERIC-SILICATE COMPOSITE

(75) Inventors: Andrew R. Wank, Avondale, PA (US); Donna M. Alden, Bear, DE (US); Mark E. Gazze, Lincoln University, PA (US); Robert Gargione, Middletown, DE (US); Joseph K. So, Wilmington, DE (US); David Drop, West Grove, PA (US); Mai Tieu Banh, Oakville (CA); Shawn Riley, Wilmington, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 278 days.

(21) Appl. No.: 12/945,587

(22) Filed: Nov. 12, 2010

(65) Prior Publication Data

US 2012/0117888 A1 May 17, 2012

(51) Int. Cl.

| | |
|---|---|
| ***D06N 7/04*** | (2006.01) |
| ***B32B 3/26*** | (2006.01) |
| ***B24D 18/00*** | (2006.01) |
| ***B24D 3/02*** | (2006.01) |
| ***C09C 1/68*** | (2006.01) |

(52) U.S. Cl. ..... 428/147; 428/305.5; 51/293; 51/308

(58) Field of Classification Search ..... 51/293, 51/308; 451/41, 59; 428/147, 305.5, 453
See application file for complete search history.

(56) References Cited

U.S. PATENT DOCUMENTS 5,578,362 A 11/1996 Reinhardt et al.

OTHER PUBLICATIONS

Copending U.S. Appl. No. 12/945,557.
Copending U.S. Appl. No. 12/945,504.
Matsui, et al., Principles and Applications of the Elbow-Jet Air Classifier, 1990, Tokyo, Japan.

*Primary Examiner* — Pegah Parvini
(74) *Attorney, Agent, or Firm* — Blake T. Biederman

(57) ABSTRACT

The invention provides a plurality of polymeric particles embedded with silicate that include gas-filled polymeric microelements. The gas-filled polymeric microelements have a shell and a density of 5 g/liter to 200 g/liter. The shell having an outer surface and a diameter of 5 μm to 200 μm with silicate particles embedded in the polymer. The silicate particles have an average particle size of 0.01 to 3 μm. The silicate-containing regions are spaced to coat less than 50 percent of the outer surface of the polymeric microelements; and less than 0.1 weight percent total of the polymeric microelements is associated with i) silicate particles having a particle size of greater than 5 μm; ii) silicate-containing regions covering greater than 50 percent of the outer surface of the polymeric microelements; and iii) polymeric micro elements agglomerated with silicate particles to an average cluster size of greater than 120 μm.

8 Claims, 4 Drawing Sheets

HOLLOW POLYMERIC-SILICATE COMPOSITE

BACKGROUND OF THE INVENTION

The present invention relates to polishing pads for chemical mechanical polishing (CMP), and in particular relates to polymeric composite polishing pads suitable for polishing at least one of semiconductor, magnetic or optical substrates.

Semiconductor wafers having integrated circuits fabricated thereon must be polished to provide an ultra-smooth and flat surface that must vary in a given plane by a fraction of a micron. This polishing is usually accomplished in a chemical-mechanical polishing (CMP) operation. These "CMP" operations utilize a chemical-active slurry that is buffed against the wafer surface by a polishing pad. The combination of the chemical-active slurry and polishing pad combine to polish or planarize a wafer surface.

One problem associated with the CMP operation is wafer scratching. Certain polishing pads can contain foreign materials that result in gouging or scratching of the wafer. For example, the foreign material can result in chatter marks in hard materials such as, TEOS dielectrics. For purposes of this specification, TEOS represents the hard glass-like dielectric formed from the decomposition of tetraethyloxysilicates. This damage to the dielectric can result in wafer defects and lower wafer yield. Another scratching issue associated with foreign materials is the damaging of nonferrous interconnects, such as copper interconnects. If the pad scratches too deep into the interconnect line, the resistance of the line increases to a point where the semiconductor will not function properly. In extreme cases, these foreign materials create mega-scratches that can result in the scrapping of an entire wafer.

Reinhardt et al., in U.S. Pat. No. 5,578,362 describe a polishing pad that replaces glass spheres with hollow polymeric microelements to create porosity within a polymeric matrix. The advantages of this design include uniform polishing, low defectivity and enhanced removal rate. The IC1000™ polishing pad design of Reinhardt et al. outperformed the earlier IC60 polishing pad for scratching by replacing the ceramic glass phase with a polymeric shell. In addition. Reinhardt et al. discovered an unexpected increase in polishing rate associated with replacing hard glass spheres with softer polymeric microspheres. The polishing pads of Reinhardt et al. have long served as the industry standard for CMP polishing and continue to serve an important role in advanced CMP applications.

Another set of problems associated with the CMP operation are pad-to-pad variability, such as density variation and within pad variation. To address these problems polishing pad manufactures have relied upon careful casting techniques with controlled curing cycles. These efforts have concentrated on the macro-properties of the pad, but did not address the micro-polishing aspects associated with polishing pad materials.

There is an industry desire for polishing pads that provide an improved combination of planarization, removal rate and scratching. In addition, there remains a demand for a polishing pad that provides these properties in a polishing pad with less pad-to-pad variability.

STATEMENT OF THE INVENTION

An aspect of the invention includes a plurality of polymeric particles embedded with silicate comprising: gas-filled polymeric microelements, the gas-filled polymeric microelements having a shell and a density of 5 g/liter to 200 gaiter, the shell having an outer surface and a diameter of 5 μm to 200 μm and the outer surface of the shell of the gas-filled polymeric particles having silicate particles embedded in the polymer, the silicate particles having an average particle size of 0.01 to 3 μm; the silicate-containing particles distributed within each of the polymeric microelements, the silicate-containing regions being spaced to coat less than 50 percent of the outer surface of the polymeric microelements; and less than 0.1 weight percent total of the polymeric microelements being associated with i) silicate particles having a particle size of greater than 5 μm; ii) silicate-containing regions covering greater than 50 percent of the outer surface of the polymeric microelements; and iii) polymeric microelements agglomerated with silicate particles to an average cluster size of greater than 120 μm.

Another aspect of the invention includes a plurality of polymeric particles embedded with silicate comprising: gas-filled polymeric microelements, the gas-filled polymeric microelements having a shell and a density of 10 g/liter to 100 g/liter, the shell having an outer surface and a diameter of 5 μm to 200 μm and the outer surface of the shell of the gas-filled polymeric particles having silicate particles embedded in the polymer, the silicate particles having an average particle size of 0.01 to 2 μm; the silicate-containing particles distributed within each of the polymeric microelements, the silicate-containing regions being spaced to coat 1 to 40 percent of the outer surface of the polymeric microelements; and less than 0.1 weight percent total of the polymeric micro elements being associated with i) silicate particles having a particle size of greater than 5 μm; ii) silicate-containing regions covering greater than 50 percent of the outer surface of the polymeric microelements; and iii) polymeric microelements agglomerated with silicate particles to an average cluster size of greater than 120 μm.

DETAILED DESCRIPTION OF THE INVENTION

Figure 1A:
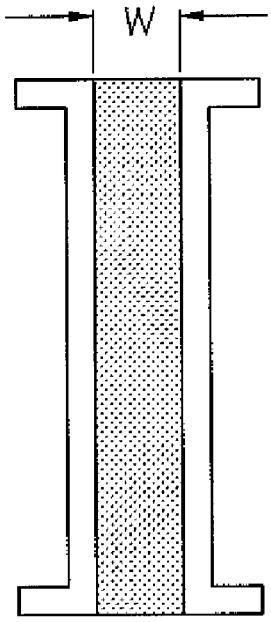
FIG. 1A represents a schematic side-view-cross-section of a Coanda block air classifier.

The invention provides a composite silicate polishing pad useful for polishing semiconductor substrates. The polishing pad includes a polymeric matrix, hollow polymeric microelements and silicate particles embedded in the polymeric microelements. Surprisingly, these silicate particles do not tend to result in excessive scratching or gouging for advanced CMP applications when classified to a specific structure associated with polymeric microelements. This limited gouging and scratching occurs despite the polymeric matrix having silicate particles at its polishing surface.

Typical polymeric polishing pad matrix materials include polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane; and may be either a cross-linked a non-cross-linked polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Preferably, the polymeric material is a block or segmented copolymer capable of separating into phases rich in one or more blocks or segments of the copolymer. Most preferably, the polymeric material is a polyurethane. Cast polyurethane matrix materials are particularly suitable for planarizing semiconductor, optical and magnetic substrates. An approach for controlling a pad's polishing properties is to alter its chemical composition. In addition, the choice of raw materials and manufacturing process affects the polymer morphology and the final properties of the material used to make polishing pads.

Preferably, urethane production involves the preparation of an isocyanate-terminated urethane prepolymer from a polyfunctional aromatic isocyanate and a prepolymer polyol. For purposes of this specification, the term prepolymer polyol includes dials, polyols, polyol-diols, copolymers thereof and mixtures thereof. Preferably, the prepolymer polyol is selected from the group comprising polytetramethylene ether glycol [PTMEG], polypropylene ether glycol [PPG], ester-based polyols, such as ethylene or butylene adipates, copolymers thereof and mixtures thereof. Example polyfunctional aromatic isocyanates include 2,4-toluene diisocyanate, 2,6-toluene diisocyanate, 4,4'-diphenylmethane diisocyanate, naphthalene-1,5-diisocyanate, tolidine diisocyanate, paraphenylene diisocyanate, xylylene diisocyanate and mixtures thereof. The polyfunctional aromatic isocyanate contains less than 20 weight percent aliphatic isocyanates, such as 4,4'-dicyclohexylmethane diisocyanate, isophorone diisocyanate and cyclohexanediisocyanate. Preferably, the polyfunctional aromatic isocyanate contains less than 15 weight percent aliphatic isocyanates and more preferably, less than 12 weight percent aliphatic isocyanate.

Example prepolymer polyols include polyether polyols, such as, poly(oxytetramethylene)glycol, poly(oxypropylene) glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 8.0 to 20.0 weight percent. For polyurethanes formed with PTMEG or PTMEG blended with PPG, the preferable weight percent NCO is a range of 8.75 to 12.0; and most preferably it is 8.75 to 10.0. Particular examples of PTMEG family polyols are as follows: Terathane® 2900, 2000, 1800, 1400, 1000, 650 and 250 from Invista; Polymeg® 2900, 2000, 1000, 650 from Lyondell; PolyTHF® 650, 1000, 2000 from BASF, and lower molecular weight species such as 1,2-butanediol, 1,3-butanediol, and 1,4-butanediol. If the prepolymer polyol is a PPG, copolymer thereof or a mixture thereof, then the isocyanate-terminated reaction product most preferably has a weight percent unreacted NCO range of 7.9 to 15.0 wt. %. Particular examples of PPG polyols are as follows: Arcol® PPG-425, 725, 1000, 1025, 2000, 2025, 3025 and 4000 from Bayer; Voranol® 1010L, 2000L, and P400 from Dow; Desmophen® 1110BD, Acclaim® Polyol 12200, 8200, 6300, 4200, 2200 both product lines from Bayer If the prepolymer polyol is an ester, copolymer thereof or a mixture thereof, then the isocyanate-terminated reaction product most preferably has a weight percent unreacted NCO range of 6.5 to 13.0. Particular examples of ester polyols are as follows: Millester 1, 11, 2, 23, 132, 231, 272, 4, 5, 510, 51, 7, 8, 9, 10, 16, 253, from Polyurethane Specialties Company, Inc.; Desmophen® 1700, 1800, 2000, 2001KS, 2001K$^2$, 2500, 2501, 2505, 2601, PE65B from Bayer; Rucoflex S-1021-70, S-1043-46, S-1043-55 from Bayer.

Typically, the prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-Cert-butyl-2,6-toluenediamine; 5-tert-amyl-2,4- and 3-tert-amyl-2,6-toluenediamine and chlorotoluenediamine. Optionally, it is possible to manufacture urethane polymers for polishing pads with a single mixing step that avoids the use of prepolymers.

The components of the polymer used to make the polishing pad are preferably chosen so that the resulting pad morphology is stable and easily reproducible. For example, when mixing 4,4'-methylene-bis-o-chloroaniline [MBCA] with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

The polyurethane polymeric material is preferably formed from a prepolymer reaction product of toluene diisocyanate and polytetramethylene ether glycol with an aromatic diamine. Most preferably the aromatic diamine is 4,4'-methylene-bis-o-chloroaniline or 4,4'-methylene-bis-(3-chloro-2,6-diethylaniline). Preferably, the prepolymer reaction product has a 6.5 to 15.0 weight percent unreacted NCO. Examples of suitable prepolymers within this unreacted NCO range include: Airthane® prepolymers PET-70D, PHP-70D, PET-75D, PHP-75D, PPT-75D, PHP-80D manufactured by Air Products and Chemicals, Inc. and Adiprene® prepolymers, LFG740D, LF700D, LF750D, LF751D, LF753D, L325 manufactured by Chemtura. In addition, blends of other prepolymers besides those listed above could be used to reach to appropriate percent unreacted NCO levels as a result of blending. Many of the above-listed prepolymers, such as, LFG740D, LF700D, LF750D, LF751D, and LF753D are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

In addition to controlling weight percent unreacted NCO, the curative and prepolymer reaction product typically has an OH or $NH_2$ to unreacted NCO stoichiometric ratio of 85 to 115 percent, preferably 90 to 110 percent; and most preferably, it has an OH or $NH_2$ to unreacted NCO stoichiometric ratio of greater than 95 to 109 percent. For example, polyurethanes formed with an unreacted NCO in a range of 101 to 108 percent appear to provide excellent results. This stoichiometry could be achieved either directly, by providing the stoichiometric levels of the raw materials, or indirectly by reacting some of the NCO with water either purposely or by exposure to adventitious moisture.

The polymeric matrix contains polymeric microelements distributed within the polymeric matrix and at the polishing surface of the polymeric matrix. The polymeric microelements have an outer surface and are fluid-filled for creating texture at the polishing surface. The fluid filling the matrix can be a liquid or a gas. If the fluid is a liquid, then the preferred fluid is water, such as distilled water that only contains incidental impurities. If the fluid is a gas, then air, nitrogen, argon, carbon dioxide or combination thereof is preferred. For some microelements, the gas may be an organic gas, such as isobutane. The gas-filled polymeric microelements typically have an average size of 5 to 200 microns. Preferably, the gas-filled polymeric microelements typically have an average size of 10 to 100 microns. Most preferably, the gas-filled polymeric microelements typically have an average size of 10 to 80 microns. Although not necessary, the polymeric microelements preferably have a spherical shape or represent microspheres. Thus, when the microelements are spherical, the average size ranges also represent diameter ranges. For example, average diameter ranges of 5 to 200 microns, preferably 10 to 100 microns and most preferably 10 to 80 microns.

The polishing pad contains silicate-containing regions distributed within each of the polymeric microelements. These silicate regions may be particles or have an elongated silicate structure. Typically, the silicate regions represent particles embedded or attached to the polymeric microelements. The average particle size of the silicates is typically 0.01 to 3 μm. Preferably, the average particle size of the silicates is 0.01 to 2 μm. These silicate-containing regions are spaced to coat less than 50 percent of the outer surface of the polymeric microelements. Preferably, the silicate containing regions cover 1 to 40 percent of the surface area of the polymeric microelements. Most preferably, the silicate containing regions cover 2 to 30 percent of the surface area of the polymeric microelements. The silicate-containing microelements have a density of 5 g/liter to 200 g/liter. Typically, the silicate-containing microelements have a density of 10 g/liter to 100 g/liter.

In order to avoid increased scratching or gouging, it is important to avoid silicate particles with disadvantageous structure or morphology. These disadvantageous silicates should total less than 0.1 weight percent total of the polymeric micro elements. Preferably, these disadvantageous silicates should total less than 0.05 weight percent total of the polymeric microelements. The first type of disadvantageous silicate is silicate particles having a particle size of greater than 5 μm. These silicate particles are known to result in chatter defects in TEOS, and scratch and gouge defects in copper. The second type of disadvantageous silicate is silicate-containing regions covering greater than 50 percent of the outer surface of the polymeric microelements. These microelements containing a large silicate surface area also can scratch wafers or dislodge with the microelements to result in chatter defects in TEOS, and scratch and gouge defects in copper. The third type of disadvantageous silicate is agglomerates. Specifically, polymeric micro elements can agglomerate with silicate particles to an average cluster size of greater than 120 μm. The 120 μm agglomeration size is typical for microelements having an average diameter of about 40 μm. Larger microelements will form larger agglomerates. Silicates with this morphology can result in visual defects and scratching defects with sensitive polishing operations.

Air classification can be useful to produce the composite silicate-containing polymeric microelements with minimal disadvantageous silicate species. Unfortunately, silicate-containing polymeric microelements often have variable density, variable wall thicknesses and variable particle size. In addition, the polymeric microelements have varied silicate-containing regions distributed on their outer surfaces. Thus, separating polymeric microelements with various wall thicknesses, particle size and density has multiple challenges and multiple attempts at centrifical air classification and particle screening failed. These processes are useful for at best removing one disadvantageous ingredient from the feedstock, such as fines. For example, because much of the silicate-laden microspheres have the same size as the desirous silicate composite, it is difficult to separate these using screening methods. It has been discovered, however, that separators that operate with a combination of inertia, gas or air flow resistance and the Coanda effect can provide effective results. The Coanda effect states that if a wall is placed on one side of a jet, then that jet will tend to flow along the wall. Specifically, passing gas-filled microelements in a gas jet adjacent a curved wall of a Coanda block separates the polymeric microelements. The coarse polymeric microelements coarse from the curved wall of the Coanda block to clean the polymeric micro elements in a two-way separation. When the feed stock includes silicate fines, the process may include the additional step of separating the polymeric microelements from the wall of the Coanda block with the fines following the Coanda block. In a three-way separation, coarse separates the greatest distance from the Coanda block, the middle or cleaned cut separates an intermediate distance and the fines follow the Coanda block. The Matsubo Corporation manufactures elbow-jet air classifiers that take advantage of these features for effective particle separation. In addition to the feedstock jet, the Matsubo separators provide an additional step of directing two additional gas streams into the polymeric microelements to facilitate separating the polymeric microelements from the coarse polymeric microelements.

The separating of the silicate fines and coarse polymeric microelements advantageously occur in a single step. Although a single pass is effective for removing both coarse and fine materials, it is possible to repeat the separation through various sequences, such as first coarse pass, second coarse and then first fine pass and second fine pass. Typically, the cleanest results, however, originate from two or three-way separations. The disadvantage of additional three-way separations are yield and cost. The feed stock typically contains greater than 0.1 weight percent disadvantageous silicate microelements. Furthermore, it is effective with greater than 0.2 weight percent and greater than 1 weight percent disadvantageous silicate feedstocks.

After separating out or cleaning the polymeric microelements, inserting the polymeric microelements into a liquid polymeric matrix forms the polishing pad. The typical means for inserting the polymeric micro elements into the pad include casting, extrusion, aqueous-solvent substitution and aqueous polymers. Mixing improves the distribution of the polymeric microelements in a liquid polymer matrix. After mixing, drying or curing the polymer matrix forms the polishing pad suitable for grooving, perforating or other polishing pad finishing operations.

Figure 1B:
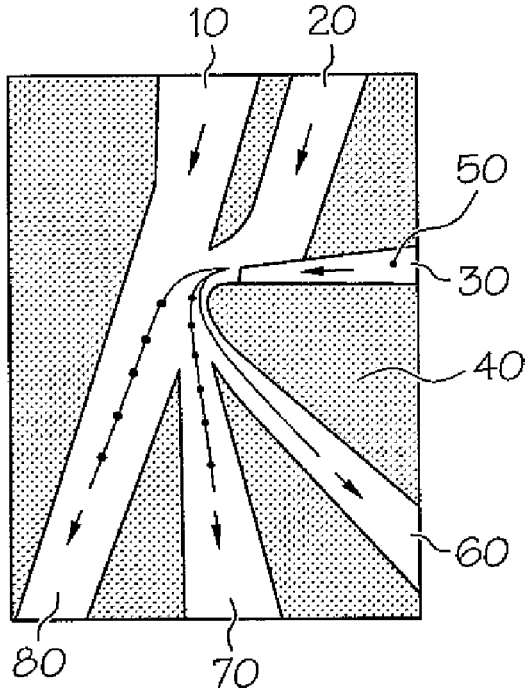
FIG. 1B represents a schematic front-view-cross-section of a Coanda block air classifier.

Referring to FIGS. 1A and 1B, the elbow-jet air classifier has width "w" between two sidewalls. Air or other suitable gas, such as carbon dioxide, nitrogen or argon flows through openings 10, 20 and 30 to create a jet-flow around Coanda block 40. Injecting polymeric microelements with a feeder 50, such as a pump or vibratory feeder, places the polymeric microelements in a jet stream initiates the classification process. In the jet stream the forces of inertia, drag (or gas flow resistance) and the Coanda effect combine to separate the particles into three classifications. The fines 60 follow the Coanda block. The medium sized silicate-containing particles have sufficient inertia to overcome the Coanda effect for collection as cleaned product 70. Finally, the coarse particles 80 travel the greatest distance for separation from the medium particles. The coarse particles contain a combination of i) silicate particles having a particle size of greater than 5 μm; ii) silicate-containing regions covering greater than 50 percent of the outer surface of the polymeric microelements; and ill) polymeric microelements agglomerated with silicate particles to an average cluster size of greater than 120 μm. These coarse particles tend to have negative impacts on wafer polishing and especially patterned wafer polishing for advanced nodes. The spacing or width of the separator determines the fraction separated into each classification. Alternatively, it is possible to close the fine collector to separate the polymeric microelements into two fractions, a coarse fraction and a cleaned fraction.

EXAMPLES

Example 1

An Elbow-Jet Model Labo air classifier from Matsubo Corporation provided separation of a sample of isobutane-filled copolymer of polyacrylnitrile and polyvinylidinedichloride having an average diameter of 40 microns and a density of 42 g/liter. These hollow microspheres contained aluminum and magnesium silicate particles embedded in the copolymer. The silicates covered approximately 10 to 20 percent of the outer surface area of the microspheres. In addition, the sample contained copolymer microspheres associated with silicate particles having a particle size of greater than 5 μm; ii) silicate-containing regions covering greater than 50 percent of the outer surface of the polymeric microelements; and iii) polymeric microelements agglomerated with silicate particles to an average cluster size of greater than 120 μm. The Elbow-Jet model Labo contained a Coanda block and the structure of FIGS. 1A and 1B. Feeding the polymeric microspheres through a vibratory feeder into the gas jet produced the results of Table 1.

TABLE 1

| Run No. | Ejector Air Pressure [MPa] | Feed time [min.] | Feed setting [—] | Feed rate [lbs/hr] [kg/h] | Edge position FAR[mm] [m3/min] | Edge position MAR[mm] [m3/min] | Air flow: ($m^3$/min) | Middle: M Yield (g) (%) | Grit: G Yield (g) (%) |
|---|---|---|---|---|---|---|---|---|---|
| 1 | 0.30 | 270 | VF | 1.3 | Closed | 25.0 | | 2560 | 8 |
| | | | 6.25 | 0.6 | 0.05 | 0.85 | 0.56 | 94.0% | 0.3% |
| 2 | 0.30 | 210 | VF | 2.0 | Closed | 25.0 | | 3058 | 6 |
| | | | 6.25 | 0.9 | 0.05 | 0.85 | 0.56 | 97.4% | 0.2% |
| 3 | 0.30 | 215 | VF | 2.0 | Closed | 25.0 | | 3212 | 6 |
| | | | 6.25 | 0.9 | 0.05 | 0.85 | 0.56 | 98.4% | 0.2% |

The data of Table 1 show effective removal of 0.2 to 0.3 weight percent coarse material. The coarse material contained copolymer microspheres associated with silicate particles having a particle size of greater than 5 μm; ii) silicate-containing regions covering greater than 50 percent of the outer surface of the polymeric microelements; and iii) polymeric microelements agglomerated with silicate particles to an average cluster size of greater than 120 μm.

The Elbow-Jet Model 15-35 air classifier provided separation of an additional lot of the silicate copolymer of Example 1. For this test series, the fines collector was completely closed. Feeding the polymeric microspheres through a pump feeder into the gas jet produced the results of Table 2.

TABLE 2

| Run No. | Edge Type | Ejector Air Pressure [MPa] | Feed Rate kg/hr | Edge Position F⊿R [mm] | Edge Position M⊿R [mm] | Yield F [g] [%] | Yield M [g] [%] | Yield G [g] [%] |
|---|---|---|---|---|---|---|---|---|
| 4 | LE | 0.3 | 15.12 | 0 | 25 | 0 | 3,005 | 18 |
| | 50G | | | | | 0.0% | 99.4% | 0.6% |
| 5 | LE | 0.3 | 14.89 | 0 | 25 | 0.0% | 2,957 | 20 |
| | 50G | | | | | 0.0% | 99.3% | 0.7% |

This material lot resulted in separation of to 0.6 and 0.7 wt % coarse material. As above, the coarse material contained copolymer microspheres associated with silicate particles having a particle size of greater than 5 μm; ii) silicate-containing regions covering greater than 50 percent of the outer surface of the polymeric microelements; and iii) polymeric micro elements agglomerated with silicate particles to an average cluster size of greater than 120 μm.

The Elbow-Jet Model 15-35 air classifier provided separation of additional silicate copolymer of Example 1. For this test series, the fines collector was open to remove the fines (Runs 6 to 8) or closed to retain fines (Runs 9 to 11). Feeding the polymeric microspheres through a pump into the gas jet produced the results of Table 3.

TABLE 3

| | Feed | Ejector | Edge Position | | Yield | | | |
|---|---|---|---|---|---|---|---|---|
| No. | Rate [kg/h] | Air Pres. [MPa] | F⊿R [mm] | M⊿R [mm] | F [g] [%] | M [g] [%] | G [g] [%] | Total[g] [%] |
| 6 | 13.5 | 0.30 | 9.0 | 25.0 | 39.5 | 860.0 | 2.1 | 901.6 |
| | | | | | 4.4% | 95.4% | 0.2% | 100.0% |
| 7 | 14.2 | 0.30 | 12.0 | 25.0 | 196.6 | 750 | 1.1 | 947.7 |
| | | | | | 20.7% | 79.1% | 0.1% | 100.0% |
| 8 | 14.2 | 0.30 | 10.5 | 25.0 | 95.1 | 850 | 1.7 | 946.8 |
| | | | | | 10.0% | 89.8% | 0.2% | 100.0% |
| 9 | 13.5 | 0.30 | 0.00 | 25.0 | 0.0 | 3310 | 17.9 | 3327.9 |
| | | | | | 0.0% | 99.5% | 0.5% | 100.0% |
| 10 | 13.2 | 0.30 | 0.00 | 25.0 | 0.0 | 3070 | 21.5 | 3091.5 |
| | | | | | 0.0% | 99.3% | 0.7% | 100.0% |
| 11 | 12.4 | 0.30 | 0.00 | 25.0 | 0.0 | 3000 | 37.3 | 3037.3 |
| | | | | | 0.0% | 98.8% | 1.2% | 100.0% |

Figure 2:
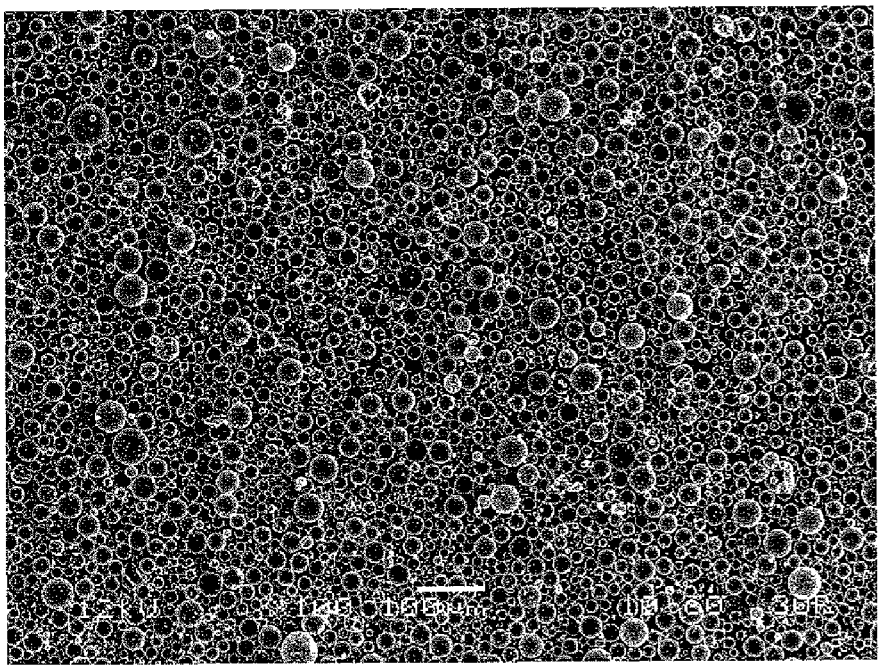
FIG. 2 represents an SEM micrograph of fine silicate-containing particles separated with a Coanda block air classifier.
Figure 3:
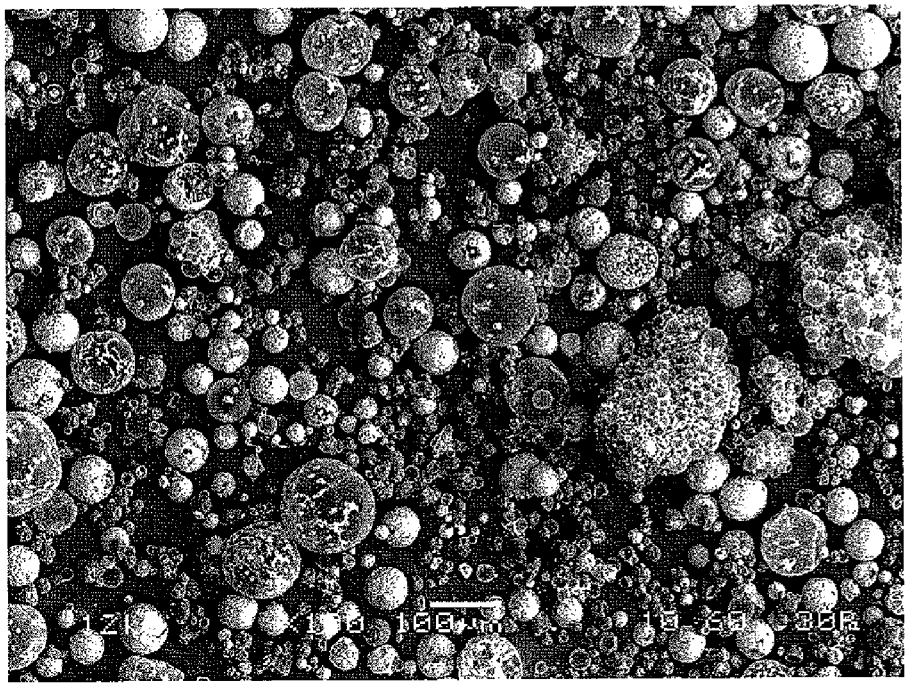
FIG. 3 represents an SEM micrograph of coarse silicate-containing particles separated with a Coanda block air classifier.
Figure 4:
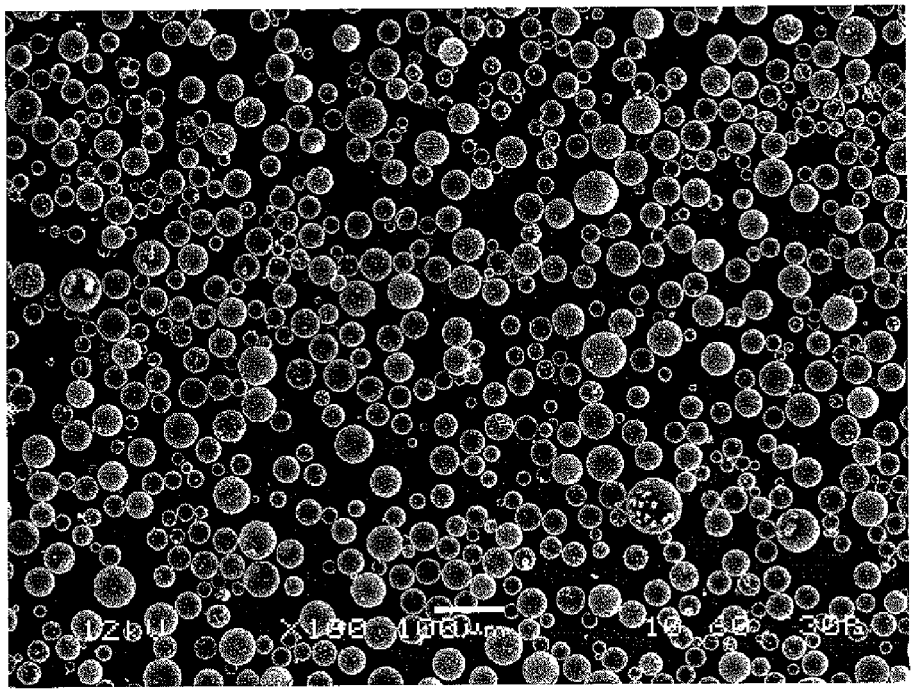
FIG. 4 represents an SEM micrograph of cleaned hollow polymeric microelements embedded with silicate particles and separated with a Coanda block air classifier.

These data show that the air classifier can readily switch between classifications into two or three segments. Referring to FIGS. 2 to 4, FIG. 2 illustrates the fines [F], FIG. 3 illustrates the coarse [G] and FIG. 4 illustrates the cleaned silicate polymeric microspheres [M]. The fines appear to have a size distribution that contains only a minor fraction of medium-sized polymeric microelements. The coarse cut contains visible microelement agglomerates and polymeric microelements that have silicate-containing regions covering greater than 50 percent of their outer surfaces. [The silicate particles having a size in excess of 5 μm are visible at higher magnifications and in FIG. 6.] The mid cut appears clear of most of the fine and coarse polymeric microelements. These SEM micrographs illustrate the dramatic difference achieved with the classification into three segments.

Example 2

The following test measured residue after combustion.

Samples of course, middle and fine cuts were placed in weighed Vicor ceramic crucibles. The crucibles were then heated to 150° C. to begin the decomposition of the silicate containing polymeric compositions. At 130° C., the polymeric microspheres tend to collapse and release the contained blowing agent. The middle and fine cuts behaved as expected, their volumes after 30 minutes had significant reduction. By contrast, however, the course cut had expanded to over six times its initial volume and showed little sign of decomposition.

These observations are indicative of two differences. First, the degree of secondary expansion in the coarse cut indicated that the relative weight percentage of the blowing agent must have been much greater in the coarse cut than in the other two cuts. Second, the silicate-rich polymer composition may have been substantially different, as it did not decompose at the same temperature.

The raw data provided in Table 4 show the coarse cut to have the lowest residue content. This result was shifted by the large difference in blowing agent content or isobutene filling the particles. Adjusting for the isobutane content relative to the degree of secondary expansion, resulted in a higher percentage for residue present in the coarse cut.

TABLE 4

| | Sample Weight (g) | Gas Weight (g) | 150° C. Post expansion volume | Sample - gas weight (g) | Residue weight (g) | Residue (%) | Residue Excluding Gas (%) |
|---|---|---|---|---|---|---|---|
| Middle Cut | 0.97 | 0.12125 | 1.4× Theoretical | 0.84875 | 0.0354 | 3.65 | 4.17 |
| Fine Cut | 1.35 | 0.16875 | 1.4× Theoretical | 1.18125 | 0.091 | 6.74 | 7.70 |
| Coarse Cut | 1.147 | 0.143375 | 1.4× Theoretical | 1.003625 | 0.0323 | 2.82 | 3.22 |
| Corrected Coarse | 1.147 | 0.716875 | 6.0× *Observed | 0.430125 | 0.0323 | 2.82 | 7.51 |

*Implies 5× to 6× higher initial gas weight

Eliminating the coarse fraction with its propensity to expand facilitates casting polishing pads with controlled specific gravity and less pad-to-pad variation.

Example 3

Figure 5:
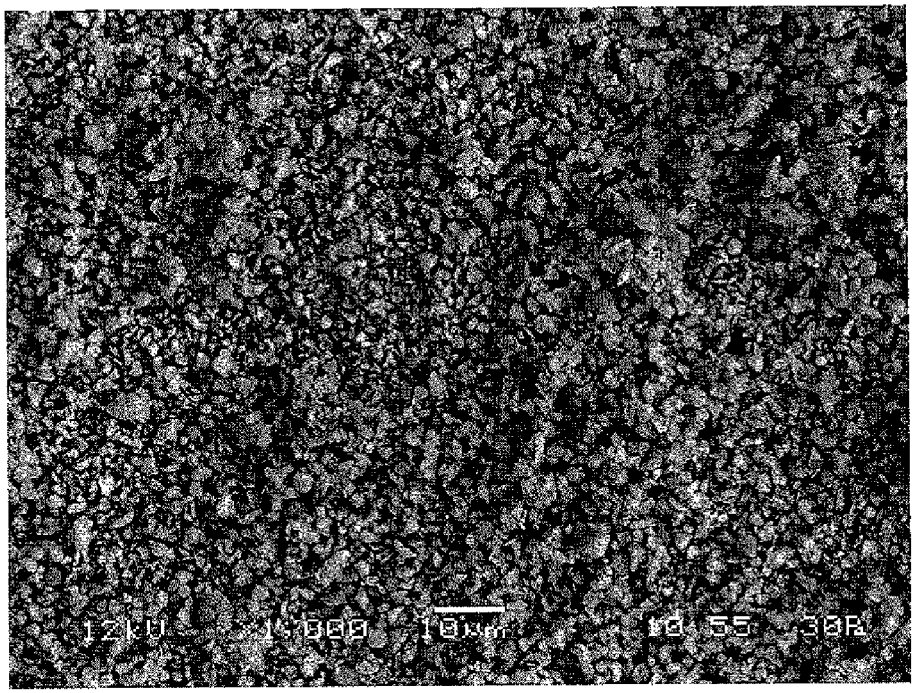
FIG. 5 represents an SEM micrograph of water separated residue from fine silicate-containing particles separated with a Coanda block air classifier.
Figure 6:
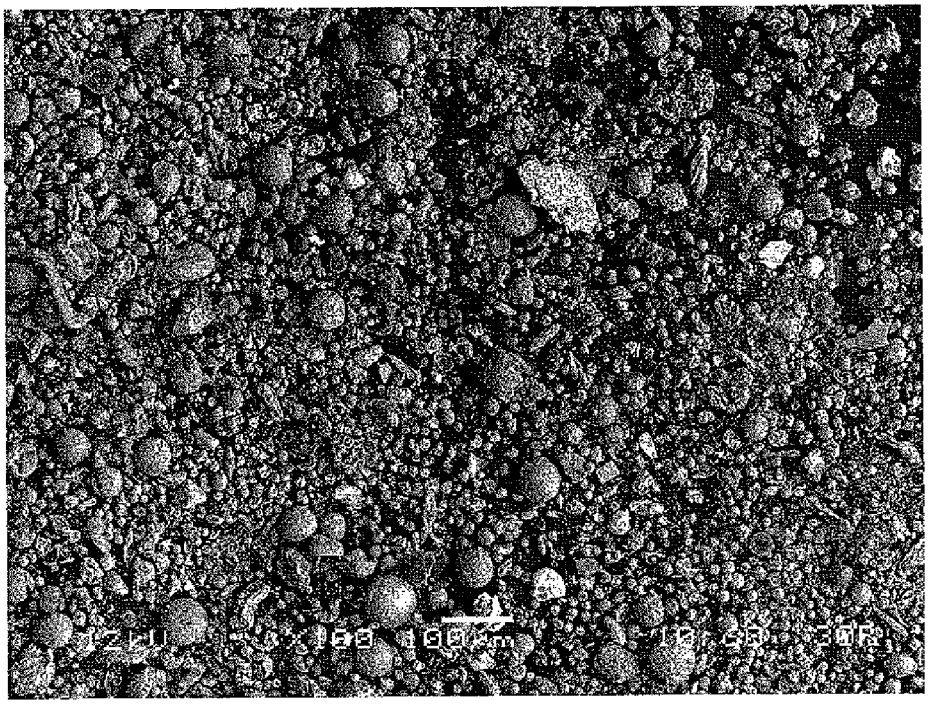
FIG. 6 represents an SEM micrograph of water separated residue from coarse silicate-containing particles separated with a Coanda block air classifier.
Figure 7:
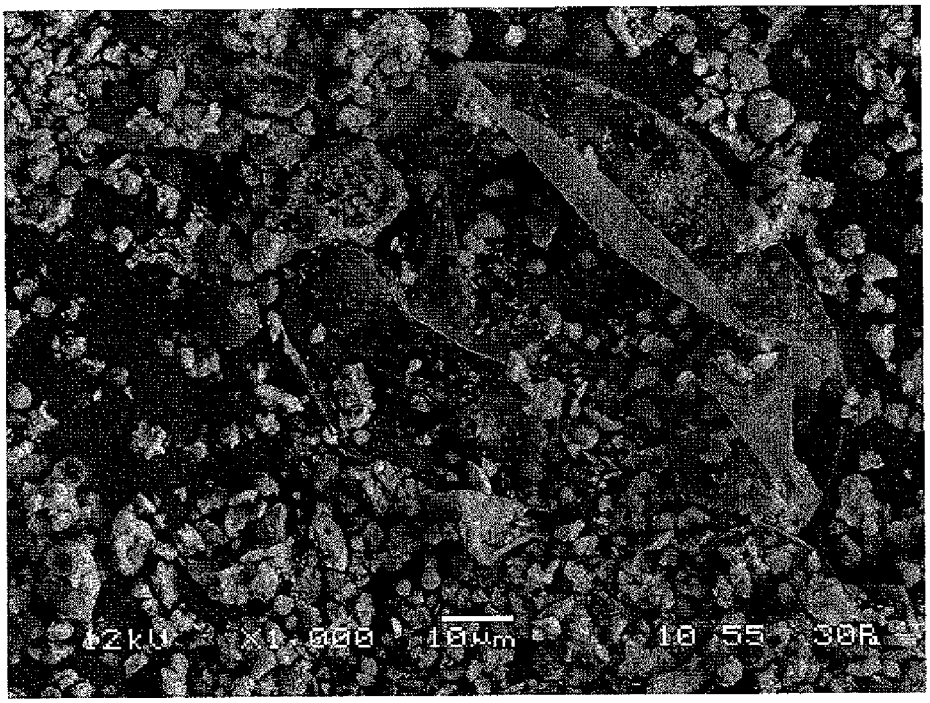
FIG. 7 represents an SEM micrograph of water separated residue from cleaned hollow polymeric microelements embedded with silicate particles and separated with a Coanda block air classifier.

After classifying with the elbow jet device, three 0.25 g cuts of processed silicate polymeric containing micro elements were immersed in 40 ml of ultra pure water. The samples were well mixed and allowed to settle for three days. The coarse cut had visible sediment after several minutes, the fine cut had visible sediment after several hours, and the middle cut showed sediment after 24 hours. The floating polymeric microelements and water were removed leaving the sediment slug and a small amount of water. The samples were allowed to dry overnight. After drying, the containers and sediment were weighed, the sediment was removed, and the containers were washed, dried and re-weighed to determine the weight of the sediment. FIGS. 5 to 7 illustrate the dramatic difference in silicate size and morphology achieved through the classification technique. FIG. 5 illustrates a collection of fine polymer and silicate particles that settled in the sedimentation process. FIG. 6 illustrates large silicate particles (greater than 5 μm) and polymeric microelements having greater than fifty percent of their outer surface covered with silicate particles. FIG. 7, at approximately ten times greater magnification than the other photomicrographs, illustrates fine silicate particles and a fractured polymeric microelement. The fractured polymeric microelement having a bag-like shape, which sank in the sedimentation process.

The final weights were as follows:

Coarse: 0.018 g

Clean (Middle): 0.001 g

Fine: 0.014 g

This Example demonstrated over a 30 to 1 separation efficiency for the Coanda block air classifier. In particular, the coarse fraction included a percentage of large silicate particles, such as particles having a spherical, semi-spherical and faceted shape. The medium or cleaned fraction contained the smallest quantity of silicates, both large (average size above 3 μm) and small (average size less than 1 μm). The fines contained the greatest quantity of silicate particles, but these particles had an average less than 1 μm.

Example 4

A series of three cast polishing pads were prepared for a polishing comparison with copper.

Table 5 contains a summary of the three cast polyurethane polishing pads.

TABLE 5

| Description | Specific Gravity (g/cm$^3$) | Polymeric Microelements (Wt %) | Hardness (Shore D) |
|---|---|---|---|
| Nominal | 0.782 | 1.9 | 55 |
| Cleaned | 0.787 | 1.9 | 55 |
| Spiked (Coarse) | 0.788 | 2.1 | 54 |

The same as Example 1, the nominal polishing pad contained isobutane-filled copolymer of polyacrylnitrile and polyvinylidinedichloride having an average diameter of 40 microns and a density of 42 g/liter. These hollow microspheres contained aluminum and magnesium silicate particles embedded in the copolymer. The silicates covered approximately 10 to 20 percent of the outer surface area of the microspheres. In addition, the sample contained copolymer microspheres associated with silicate particles having a particle size of greater than 5 μm; ii) silicate-containing regions covering greater than 50 percent of the outer surface of the polymeric micro elements; and iii) polymeric microelements agglomerated with silicate particles to an average cluster size of greater than 120 μm. The cleaned pad contained less than 0.1 wt % of items i) to iii) above after air classification with the Elbow-Jet Model 15-3S air classifier. Finally, the spiked pad contained 1.5 wt % of the coarse material of items i) to iii) above with a balance of nominal material.

Polishing the pads on blank copper wafers with abrasive-free polishing solution RL 3200 from Dow Electronic Materials provided comparative polishing data for gouges and defects. The polishing conditions were 200 mm wafers on an Applied Mirra tool using a platen speed of 61 rpm and a carrier speed of 59 rpm. Table 6 below provides the comparative polishing data.

TABLE 6

| Polishing Pad | Wafer Count | Gouge (% Defect) | Scratch (% Defect) | Total (% Defect) |
|---|---|---|---|---|
| Nominal | 84 | 16 | 49 | 65 |
| Nominal | 110 | 19 | NA | NA |
| Cleaned | 84 | 5 | 6 | 11 |
| Cleaned | 110 | 9 | 1 | 10 |
| Spiked | 84 | 10 | 2 | 12 |
| Spiked | 110 | 19 | 13 | 32 |

NA = Not Available

The data of Table 6 illustrate a polishing improvement for percent gouge defects for the uniform silicate-containing polymer. In addition, these data may also show an improvement for copper scratching, but more polishing is necessary.

The polishing pads of the invention include silicates distributed in a consistent and uniform structure to reduce polishing defects. In particular, the silicate structure of the claimed invention can reduce gouge and scratching defects for copper polishing with cast polyurethane polishing pads. In addition, the air classification can provide a more consistent product with less density and within pad variation.

The invention claimed is:

1. A plurality of polymeric particles embedded with silicate comprising:

gas-filled polymeric microelements, the gas-filled polymeric microelements having a shell and a density of 5 g/liter to 200 g/liter, the shell having an outer surface and a diameter of 5 μm to 200 μm and the outer surface of the shell of the gas-filled polymeric particles having silicate particles embedded in the polymer, the silicate particles having an average particle size of 0.01 to 3 μm; the silicate-containing particles distributed within each of the polymeric microelements, the silicate-containing regions being spaced to coat less than 50 percent of the outer surface of the polymeric microelements; and less than 0.1 weight percent total of the polymeric microelements being associated with i) silicate particles having a particle size of greater than 5 μm; ii) silicate-containing regions covering greater than 50 percent of the outer surface of the polymeric microelements; and iii) polymeric microelements agglomerated with silicate particles to an average cluster size of greater than 120 μm.

2. The plurality of polymeric particles of claim 1 wherein the gas-filled polymeric microelements are a copolymer of polyacrylnitrile and polyvinylidinedichloride filled with isobutane.

3. The plurality of polymeric particles of claim 1 wherein the gas-filled polymeric microelements have an average size of 5 to 200 microns.

4. The plurality of polymeric particles of claim 1 wherein the silicate-containing particles cover 1 to 40 percent of the outer surface of the shell of the gas-filled polymeric microelements.

5. A plurality of polymeric particles embedded with silicate comprising:

gas-filled polymeric microelements, the gas-filled polymeric microelements having a shell and a density of 10 g/liter to 100 g/liter, the shell having an outer surface and a diameter of 5 μm to 200 μm and the outer surface of the shell of the gas-filled polymeric particles having silicate particles embedded in the polymer, the silicate particles having an average particle size of 0.01 to 2 μm; the silicate-containing particles distributed within each of the polymeric microelements, the silicate-containing regions being spaced to coat 1 to 40 percent of the outer surface of the polymeric microelements; and less than 0.1 weight percent total of the polymeric microelements being associated with i) silicate particles having a particle size of greater than 5 μm; ii) silicate-containing regions covering greater than 50 percent of the outer surface of the polymeric microelements; and polymeric microelements agglomerated with silicate particles to an average cluster size of greater than 120 μm.

6. The plurality of polymeric particles of claim 5 wherein the gas-filled polymeric microelements are a copolymer of polyacrylnitrile and polyvinylidinedichloride filled with isobutane.

7. The plurality of polymeric particles of claim 5 wherein the gas-filled polymeric microelements have an average size of 10 to 100 microns.

8. The plurality of polymeric particles of claim 5 wherein the silicate-containing particles cover 2 to 30 percent of the outer surface of the shell of the gas-filled polymeric microelements.

* * * * *